US005187913A

United States Patent [19]

Leveau

[11] Patent Number: 5,187,913

[45] Date of Patent: Feb. 23, 1993

[54] INSULATING AND FIRE-RETARDANT PARTITIONING PANEL

[76] Inventor: Jean-Claude Leveau, 6, impasse Calmette, 78350 Jouy en Josas, France

[21] Appl. No.: 626,214

[22] Filed: Dec. 12, 1990

[30] Foreign Application Priority Data

Dec. 13, 1989 [FR] France ..... 89 16487

[51] Int. Cl.[5] ..... E04B 2/32; E04C 2/34

[52] U.S. Cl. ..... 52/584; 52/403; 52/586; 52/802; 52/809

[58] Field of Search ..... 52/802, 804, 809, 585, 52/584, 586, 587, 403, 404

[56] References Cited

U.S. PATENT DOCUMENTS 3,110,370 11/1963 Wulf, Jr. et al. ..... 52/802
4,024,309 5/1977 Pender .
4,183,393 1/1980 Bailey ..... 52/802
4,438,614 3/1984 Raith et al. ..... 52/802

FOREIGN PATENT DOCUMENTS 300289 6/1972 Austria .
1376610 9/1964 France .
2301384 9/1976 France .
77308 8/1977 Luxembourg .
1116700 6/1968 United Kingdom .

*Primary Examiner*—Michael Safavi
*Attorney, Agent, or Firm*—Dennison, Meserole, Pollack & Scheiner

[57] ABSTRACT

Insulating and fire-retardant partitioning panel including a core (12) of cellular glass glued between two facings (14) to form a composite sandwich-type structure.

4 Claims, 4 Drawing Sheets

INSULATING AND FIRE-RETARDANT PARTITIONING PANEL

The invention relates to an insulating and fire-retardant partitioning panel. Panels of this type are already known which generally include a sandwich structure formed of a core of rock wool disposed between two facings.

These panels do not give complete satisfaction, since there is necessarily a mechanical connection between the two facings, which creates thermal and acoustic bridges.

Moreover, mounting these known panels to one another requires assembly means such as metal sections, which also represent a source of thermal and acoustic bridges.

As a consequence, one of the objects of the invention is to procure an insulating and fire-retardant partitioning panel that makes it possible to overcome the above disadvantages.

In particular, it is an object of the invention to procure such a panel which has excellent insulating and fire-retardant characteristics, and which does not engender the creation of thermal and acoustic bridges.

It is another object of the invention to procure a panel of this kind that can be placed easily, without using complicated tools.

More particularly, the invention relates to an insulating and fire-retardant partitioning panel that, in its essential characteristic includes a core of cellular glass glued between two facings to form a composite sandwich-type structure. Although cellular glass is a known insulating material, it had never been used until now to make partitioning panels, since it is a fragile material that moreover is in the form of small-sized blocks.

In addition, until now, it had never been possible to discover an adhesive suitable to assure strong gluing of the cellular glass to a facing, regardless of the material the facing was made of.

Within the scope of the invention, the term "cellular glass" is intended to designate foamed or multicellular glass with closed pores, which is typically in the form of blocks, or a conglomerate of beads of cellular glass or expanded glass, having a diameter of about 5 to 15 mm. In this last case, the cellular glass may be molded directly between the two facings.

In a another feature of the invention, the facings are each formed of a metal sheet, for example of steel or aluminum, optionally including an outer coating, for example a primer or a plastic PVC-type coating.

In a first embodiment of the invention, each of the facings is a half-shell of sheet metal including a planar rectangular sheet which on its four sides has borders folded over along the edges of the panel.

Since the two facings are glued to both sides of the cellular glass core, it is unnecessary to provide for a mechanical connection between the folded-over borders of the two half-shells, thereby precluding the creation of thermal or acoustic bridges.

Advantageously, two respective folded-over borders of the two half-shells, located on the same side of the panel, comprise means for assembling the panel to an adjacent panel. Preferably, such assembly means are provided on the two vertical sides of the same panel.

In a preferred embodiment of the invention, each of the folded-over borders includes a first part perpendicular to the sheet and folded over onto the edge of the panel, having a width less than one-half the thickness of the core, a second part folded perpendicular to the first part, and a third part folded perpendicular to the second, the two folded-over borders located on the same side of the panel being arranged to cooperate with the two similar folded-over borders of an adjacent panel, to receive two clip sections of U-shaped cross section, each one including a central core extending parallel to the plane of the panels and two flanges each pressed against the first part of a folded-over border by means of a spring.

It then suffices, at the time of assembly, to place the panels adjacent one another and to force-fit two clip sections together at a time.

In another variant the two respective folded-over borders of the two half-shells include a first part folded over toward the edge of the panel and a second part folded parallel to the plane of the panel, in such a manner as to form a male-type nesting element. Advantageously, an insulating gasket is glued between the second respective parts of the folded-over borders to form a tongue, without creating thermal or acoustic bridges between the two half-shells.

Still in this same variant the two respective folded-over borders of the two half-shells include a first part folded over along the edge and a second part folded in the thickness of the cellular glass core, to form a female-type nesting element.

This female fitting element may cooperate with a male element as defined above.

In a variant, a simulated tongue, glued in a female-type nesting element to form a male-type nesting element in this way, may be provided.

In another embodiment of the invention, each facing is a metal sheet extending over the entire surface of the panel. In such cases, the metal shell does not include folded-over borders as defined above.

Advantageously, each panel includes a groove along its edge on at least one side, arranged to receive a simulated tongue of generally rectangular cross section. Thus when the simulated tongue of a panel is engaged in the groove of an adjacent panel, there is practically no visible joint between the two panels.

The groove formed at the edge of the panel is advantageously defined by a section of sheet metal engaged in the thickness of the cellular glass core.

Preferably, a fireproofing gasket is put into place between two adjacent panels on either side of the simulated tongue.

This simulated tongue advantageously comprises a bar of generally rectangular cross section. It may be a solid bar, or a strong hollow bar, especially for very high panels.

In another embodiment of the invention, the facings are formed not of sheets of metal, but of sheets based on a silicate of alumina fibers.

These facings may then be decorated in any suitable manner.

Thus the two facings include assembly means for example of the mortise and tenon type or the type including two sections connected to either side of the panels, or also the type using clip section means.

To achieve gluing of the cellular glass core to the two facings, regardless of the material they are made of, a two-component polyurethane adhesive or also a contact adhesive is used according to the invention.

In the ensuing description, given solely by way of example, reference is made to the accompanying drawings, in which.

Figure 11:
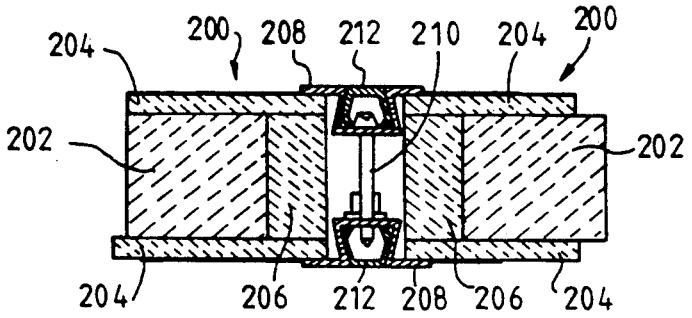
Figure 12:
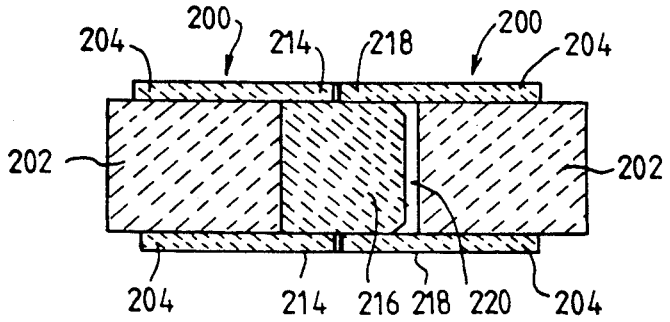
Figure 13:
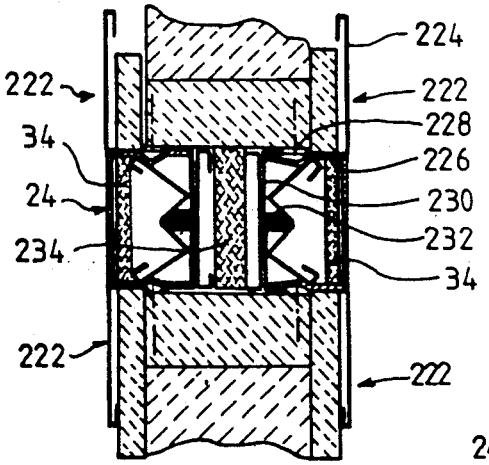
Figure 14:
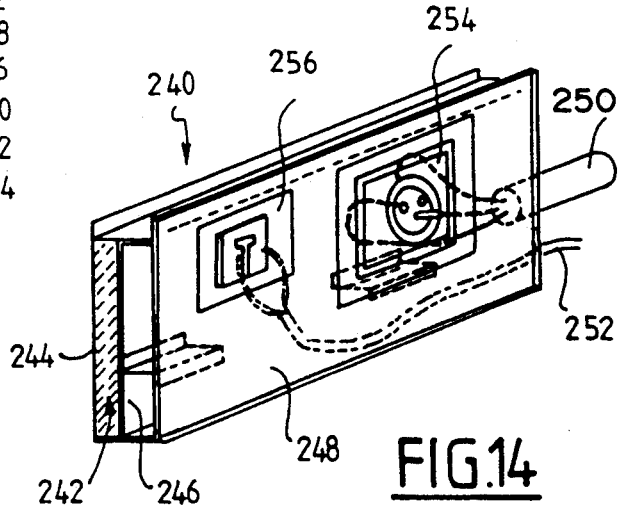

FIGS. 11, 12 and 13 respectively show the assembly of two panels including nonmetallic facings; and FIG. 14 is a perspective view showing the embodiment of a partitioning panel in the form of a plinth.

Figure 1:
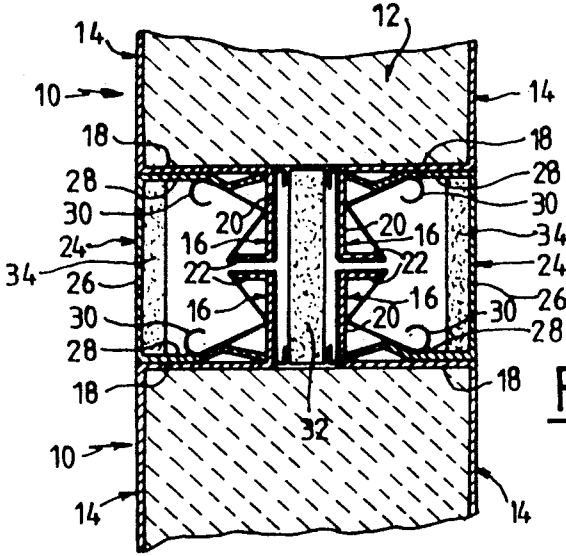
FIG. 1 is a fragmentary cross-sectional view of the assembly of two panels in a first embodiment of the invention.

Turning first to FIG. 1, the assembly of two panels 10 according to the invention is shown. Each panel 10 includes a core 12 formed of blocks of cellular glass of the same thickness, which are glued respectively to two facings 14. In this embodiment, each facing 14 is a half-shell including a rectangular sheet folded over on all four sides. In the example, each of the half-shells is folded over on its vertical sides to form a folded-over border 16. Each folded-over border 16 includes a first part 18 folded at a right angle along the corresponding edge of the panel and extending over a width less than half the width of the core 12. The first part 18 joins a second part 20 folded perpendicular thereto, parallel to the plane of the panels, which in turn joins a third part 22 that extends over a small width. When the panels are arranged adjacent one another, as shown in FIG. 1, the four folded-over borders 16 receive two clip sections 24 of U-shaped cross section. Each section includes a central portion 26 that is parallel to the plane of the panels and two flanges 28 that each press against the first part 18 of a folded-over border 16, by means of a spring 30. In the embodiment shown, four springs 30 are used, each of which engages the second part 20 and third part 22 of a folded-over border 16.

The panels 10 shown in FIG. 1 may have a height of 2.50 m to 3.50 m, for example, and a width corresponding to a grid of 60 or 90 cm, for example. In the example, the panels have a total thickness of 50 mm.

To improve the insulating and fire-retardant properties of the panels at the time of their assembly, a gasket 32, disposed in the space defined by the four second parts 20 of the folded-over borders 16, and two gaskets 34, disposed respectively in the bottom of the clip sections 24, are provided. These gaskets are advantageously made of a mat of fibers of silicate of alumina.

Figure 2:
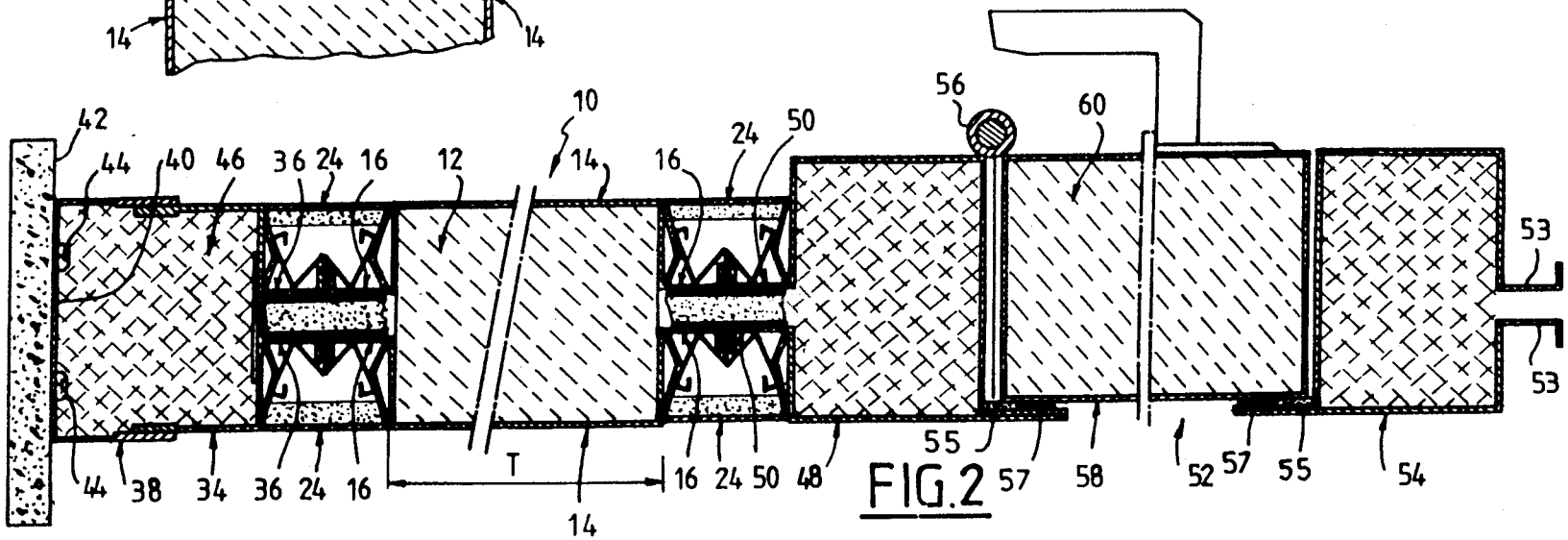
FIG. 2 is a horizontal sectional view of a partition including at least one panel of the kind shown in FIG. 1.

Turning now to FIG. 2, a partition is shown in section including a partitioning panel 10 identical to those of FIG. 1 and having a horizontal grid T. The panel 10 is assembled by one of its vertical sides to a junction element 34 comprising a U-section with two projecting folded members 36 spaced apart from one another, in a configuration analogous to that of the folded-over borders 16 of the panel. The element 34 is affixed with its flanges to another junction element 38 comprising a section with a U-shaped cross section. The element 38 has a central section 40 which is fixed to a wall or transverse partition 42 by means of screws 44. In the space defined between the elements 34 and 38, filling 46 is provided, for example made of fibers of silicate of alumina. The panel 10 is fixed to the junction element 34 by means of two clip sections 24 identical to those shown in FIG. 1.

The opposite vertical side of the panel 10 is fixed, by way of two clip sections 24, to a vertical member 48 of a door frame that has two folded-over borders 50 of the same configuration as the folded-over borders 16 of the panel 10. The vertical member 48 is part of a door frame 52 which includes another vertical member 54 that is likewise provided with two folded-over borders 53. The vertical member 48 comprises hinges 56 for mounting a door 58 including a core 60 of cellular glass. The vertical members 48 and 54 also include a fire-retardant filling, for example based on silicate of alumina fibers.

Two gaskets 55 and 57 of different types are placed in the rabbet of the vertical door frame members. The gasket 55 is an isophonic gasket of polyethylene foam, which is placed in the bottom of the rabbet. The gasket 57 is a swelling gasket which is located to the side of the gasket 55 and near the edge of the rabbet, in a plane parallel to that of the door 58. The gasket 57 is a hard gasket which cannot serve as a cushion when the door is closed. The gaskets 55 and 57 form a fire-retardant continuity between the door and the partition.

In case of fire on either side of the door, the door is always sealed against fire, smoke and gas. In fact, the swelling gasket 57 increases the volume, for example quadruples the volume, and thus creates the seal at the base of the rabbet.

Figure 3:
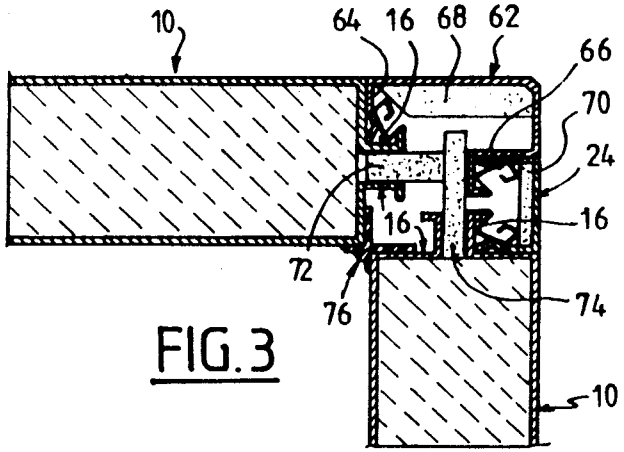
FIG. 3 is a sectional view of a corner partition.

Turning now to FIG. 3, the corner connection of two panels 10 according to the invention is shown by means of a clip section 24 analogous to those of FIGS. 1 and 2 and a clip section 62 forming an angle return. This section 62 has the form of an angle iron which is provided with one flange 64, analogous in structure to the flange 28 of the section 24, and a folded-over border 66, similar in configuration to that of the folded-over border 16 of a panel 10. The flange 64 is clipped into the over border 16 of one of the panels 10, while its folded-over folded-border 66 cooperates with a folded-over border 16 of the other panel 10 in order to receive the clip section 24. Mats 68 and 70 of insulating and fireproof material, for example of silicate of alumina, are disposed in the section 62 and the section 24, respectively. Moreover, two further mats 72 and 74 are provided inside the angle junction. In the inside angle of the two panels, an extruded gasket 76 in the form of an X is provided, based on neoprene, for example, or made of extruded silicone.

Figure 4:
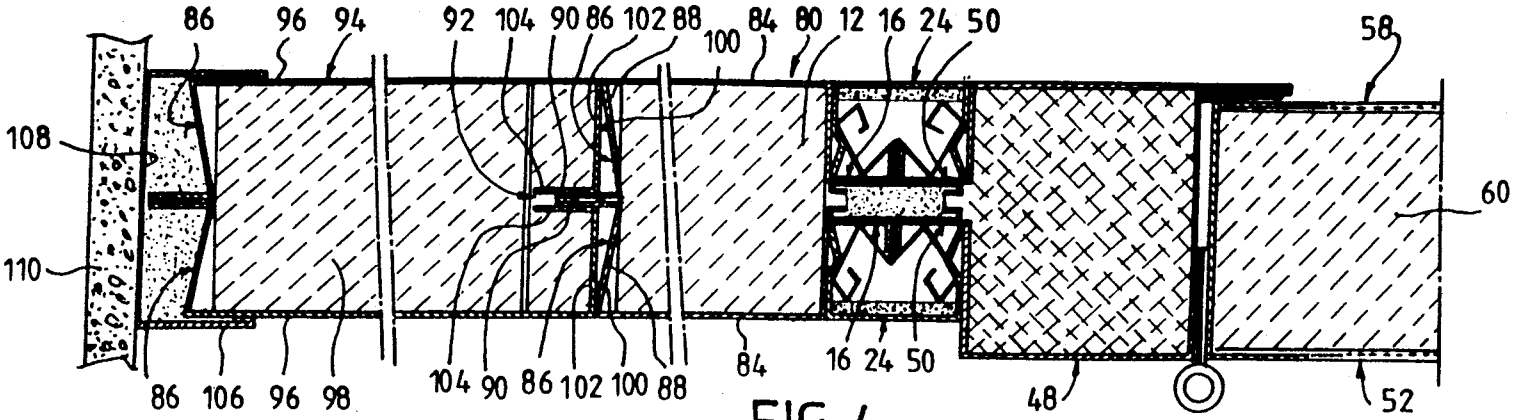
FIG. 4 is a horizontal sectional view of a partition including at least one partitioning panel in another embodiment.

Turning now to FIG. 4, a partition is shown including a panel 80 according to the invention, having a core 12 of cellular glass and two sheets 84 forming half-shells. On one of the vertical borders of the panel 80, the two sheets 84 define folded-over borders 16 similar to those described above. The panel 80 is assembled by its two folded-over borders 16 to a vertical door frame member 48 similar to that of FIG. 2. This vertical member also includes two folded-over borders 50 enabling the assembly of the panel 80 and the vertical member 48 by two clip sections 24. The vertical member 48 is part of a door frame 52 that includes a door 58 provided with a cellular glass core 60.

On the other vertical side of the panel 80, the shells 84 form two folded-over borders 86. Each border 86 includes a first part 88 that forms an angle slightly less than 90° with the plane of the panel, and a part 90 that extends parallel to the plane of the panel. The two parts 90 are joined to each other to form a male element 92 in the form of a simulated tongue. Via its assembly element 92, the panel 80 cooperates with a panel 94 including two facings 96 in the form of half-shells and a core 98 of cellular glass. The facings 96 include two folded-over borders 100, each comprising a first part 102 folded over at a right angle and having a width less than half the thickness of the core 98, and a second part 104 which extends to the inside of the panel. The two parts 104 between them define a groove for receiving the simulated tongue 92.

On its opposite side, the panel 94 includes two folded-over borders 86 similar to those of the panel 80. The panel 94 is wedged into a U-section junction 106, the central section 108 of which is fastened to a partition 110.

Figure 5:
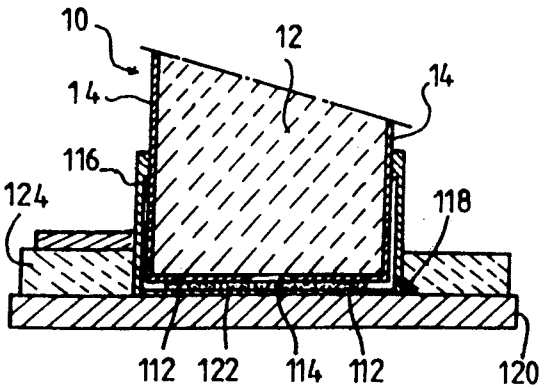
FIG. 5 is a vertical section showing the mounting of the base of a panel.

As shown in FIG. 5, the half-shells 14 of the panel 10 in the lower portion form two folded-over borders 112, which have an empty space 114 therebetween. The base of the panel 10 is wedged into a horizontal section 116 with a U-shaped cross section, which is fastened by spot welds 118 to a metal floor 120. A layer 122 of vibration-reducing non-flammable material is disposed between the bottom of the section 116 and the base of the panel 10. A layer of a material 124 is disposed on the floor 120 to even the ground.

Figure 6:
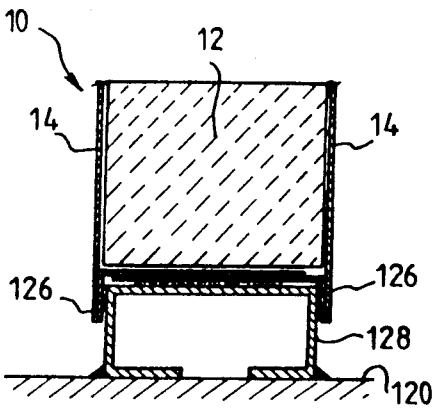
FIG. 6 is a vertical sectional view showing another mounting of the base of a panel.

In the embodiment of FIG. 6, the two half-shells 14 of the panel 10 include folded-over borders 126 in the lower portion, which extend beyond and in the plane of the panel. The two borders 126 enable wedging of the base of the panel to a section 128 welded to the floor 120. The section 128 is a hollow bar of generally rectangular cross section, slit on one of its long bases, giving it the general shape of an omega.

Figure 7:
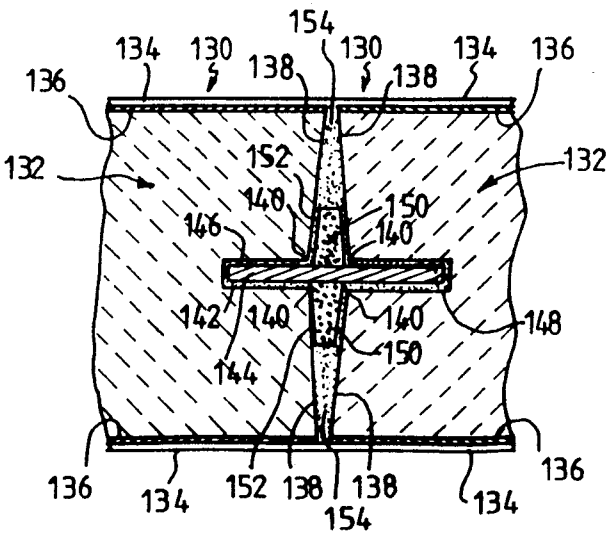
FIG. 7 is a horizontal sectional view showing the assembly of two panels in another embodiment.

Turning now to FIG. 7, the assembly of two panels 130 according to the invention is shown. Each panel includes a cellular glass core 132 glued to sheet metal facings 34, for example of steel, via a layer of adhesive 136. The facings 134, forming half-shells, include folded-over borders 138 that form an angle of approximately 90° with the plane of the panel. The folded-over borders 138 include respective ends 140 located a slight distance apart. In the core 132 of the panel 130, located on the left-hand side of FIG. 7, a groove 142 is made, in which a simulated tongue 144 is affixed by way of a layer of adhesive 146. This tongue is arranged to cooperate with a groove made by a U-section 148, the free edges of which are joined to the ends 140 of the folded-over borders 138 of the other panel 130. The section 148 thus forms a female element arranged to cooperate with the simulated tongue 144. To make for perfect tightness between the two panels, a gasket base 150 is provided, for example of polyethylene foam, glued at 152 to the edge of the left-hand panel 130, on either side of the tongue. Two gaskets 154, for example of silicone, are also provided in the outermost regions of the edge. When the two panels 130 are fitted into one another, the gaskets 150 are crushed, as are the gaskets 154, and the excess material can be scraped from the outside. A practically invisible junction between the two panels is thus attained.

Figure 8:
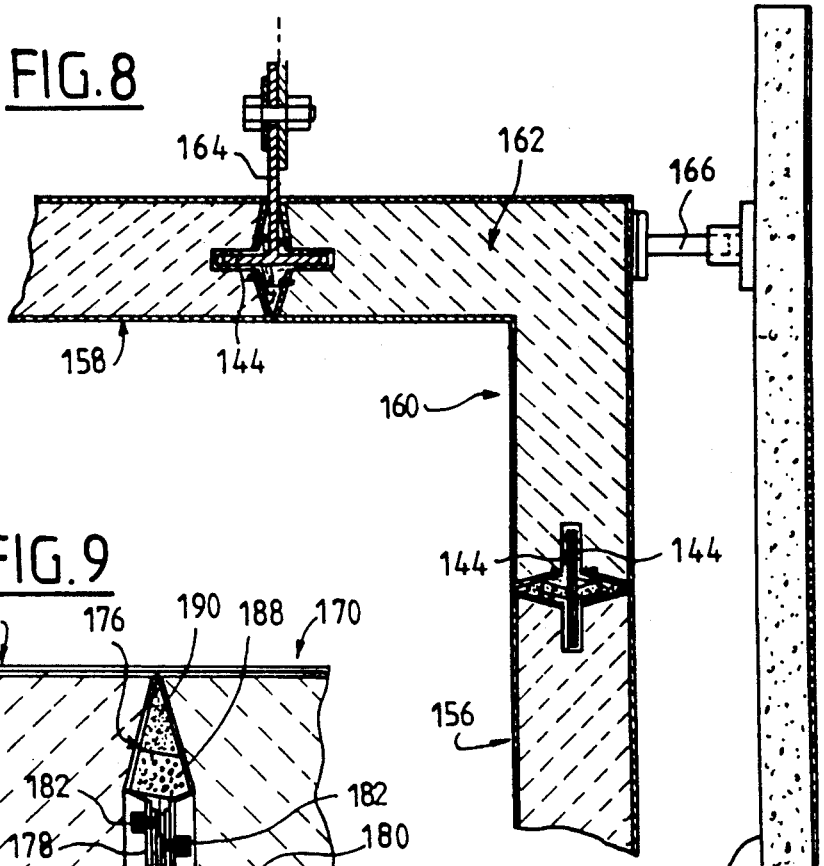
FIG. 8 is a vertical sectional view showing the assembly of panels as shown in FIG. 7.

Turning now to FIG. 8, two panels 156 and 158 are shown, similar to the panels 130 of FIG. 7, disposed vertically, to form a partition, and horizontally, to form a ceiling, respectively. The panels 156 and 158 are joined together by an angle panel 160 made in accordance with the same principle and including a cellular glass core 162. The panels 156 and 158 are assembled to the panels 160 respectively by simulated tongues 144. The simulated tongue 144 connecting the panels 158 and 162 is welded to an upper attachment 164 enabling the fixation of the assembly. Additionally, a lifting screw 166 is provided to maintain the spacing between the panel 160 and a vertical wall 168.

Figure 9:
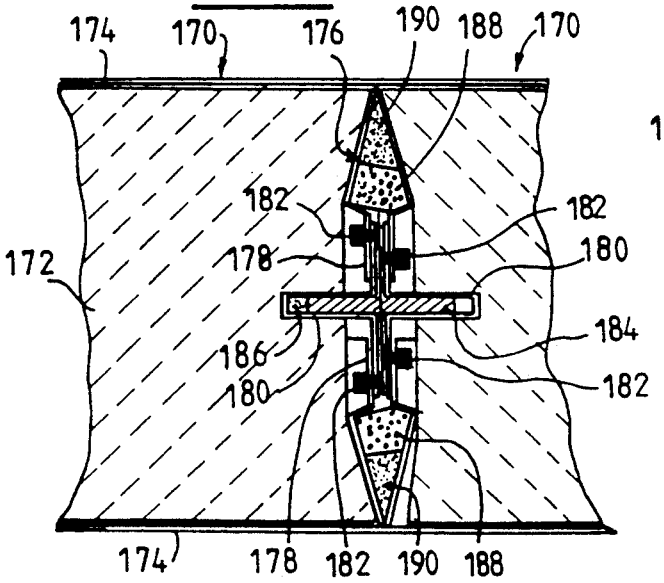
FIG. 9 is a horizontal sectional view showing the assembly of two panels in another embodiment.

Turning now to FIG. 9, two panels 170 are shown, having a structure similar to that of the panels 130 of FIG. 7. Each panel includes a cellular glass core 172 between two half-shells 174 of sheet metal. Each of them includes a folded-over border 176 that is not perpendicular to the plane of the panel. Each border 176 includes an extension 178 that extends perpendicular to the plane of the panel. The extensions 178 of the same panel serve for fixation to a U-section 180, via rivets 182. The assembly of the two panels is effected by means of a simulated tongue 184 which is affixed in one of the two sections 180 by a layer of adhesive 186. The tightness of the assembly is obtained by two compressible gaskets 188, for example of polyethylene foam, and two gaskets 190 of a material capable of yielding, such as silicone.

Figure 10:
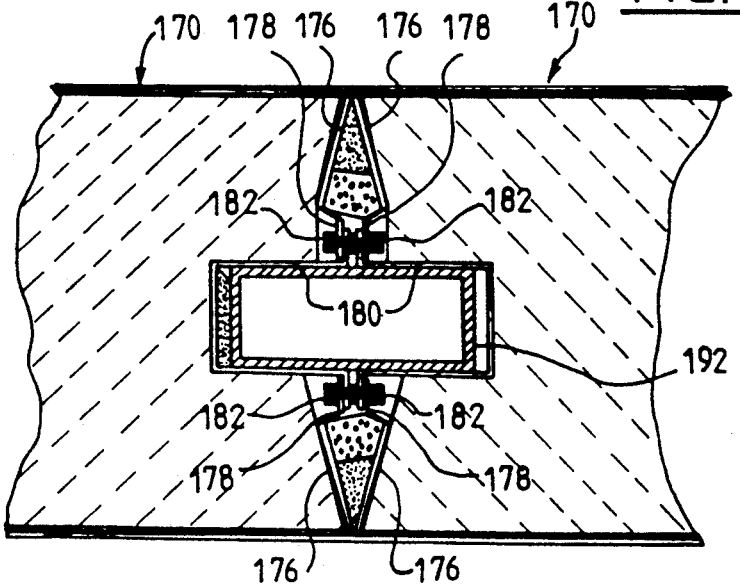
FIG. 10 is a horizontal sectional view of the assembly of two panels in a variant embodiment.

In the embodiment of FIG. 10, which will be referred to now, a simulated tongue 192 is used, comprising a hollow tube of rectangular cross section instead of a bar N as in the case of FIG. 9. The use of such a tube is particularly recommended to make walls of great height.

Turning now to FIG. 11, the assembly of two panels 200 is shown, each including a core 202 of cellular glass and two facings 204 made of a nonmetallic material, for example a sheet of fibers of silicate of alumina. The two sheets 204 extend over the entire surface of the panel. In the region near the edges of the panels, bars 206 of rectangular cross section are provided, preferably formed of the same material as the sheets 204. The assembly of the two panels 200 as obtained in this example by two junction sections 208, the cross section of which resembles an omega. The two sections are locked to one another by means of a screw 210. After being screwed together, a gasket cover 212 is wedged by force into each of the gaskets 208.

Turning now to FIG. 12, the panels 200 are shown connected to one another by a mortise and tenon type of assembly. The sheets 204 on the panel 200 shown on the left of FIG. 12 have borders 214 that extend past the core 202, for the placement of a tenon 216 of generally rectangular cross section. This tenon is preferably made of the same material as the sheets 204 and is glued between them.

In the panel 200 shown on the right of the drawing, the sheets 204 have borders 218 that extend past the core 202 to form a mortise 220 serving to receive the tenon 216.

In the embodiment of FIG. 13, the panels are assembled to one another via clip sections 24 analogous to those described in conjunction with FIGS. 1 and 2. To accomplish this, four angle sections 222 are used, which are affixed in pairs to the respective edges of the two panels 200. Each section 222 includes a portion 224 arranged to come to press against the outer face of a sheet 204, and a second portion 226 perpendicularly adjoining the portion 224 and having an opening 228 for the fixation of the section 222, for example by means of a screw (not shown). The portion 228 is extended via a third right-angle portion 230 and a fourth right-angle portion 232. The result is a folded-over border the shape of which is identical to that of the folded-over borders 16 shown in FIG. 1. Once again, a central layer 234 of an insulating, fireproof material is provided. Similarly, layers 34 of insulating, fireproof material are provided in the respective bottoms of the two clip sections 24, as described already in conjunction with FIG. 1.

Turning now to FIG. 14, a partitioning panel according to the invention made in the form of a plinth is shown. The panel 240 includes a cellular glass core 242 glued between a facing 244 and a facing 246. The plinth 240 further includes a removable cover 248, which with the facing 246 defines a hollow space for the passage of an electric cord 250 and a telecommunications cord 252, which are connected respectively to two plugs 254 and 256 that are solidly attached to the cover 248. The plinth 240 may be placed on the ground, for example with the aid of a U section as shown in FIG. 5, and it may then receive one or more panels according to the invention, placed vertically on top of the plinth.

Gluing of the cellular glass core to the facings, whether they are facings made of sheet metal or of sheets of silicate of alumina fibers, is done with the aid of an adhesive of the two-component polyurethane type, or with the aid of a contact adhesive. To fabricate such a panel, one of the facings is disposed horizontally; a layer of adhesive is placed on the inside face of the facing; blocks of cellular glass of the same thickness are then placed adjacently, in order to cover the entire surface of the facing; another layer of adhesive is deposited on the showing side of the thus-formed core; and the second facing is then applied. It is applied under pressure, and if necessary the setting of the adhesive is accelerated by heating.

As indicated above, instead of using blocks of cellular glass, a conglomerate of beads of cellular glass may be used, which are molded directly between the facings.

The partitioning panels of the invention may be made in various forms and with various dimensions and may have different types of facings as noted above. These panels may be planar, curved inward, bent at an angle, etc.

In all cases, panels that are particularly fire-resistant and that do not create thermal or acoustic bridges are obtained.

I claim:

1. An insulating, fire-retardant partitioning panel including a core of cellular glass between two facings to form a composite sandwich-type structure with edges, characterized in that the cellular glass core is joined to the two facings by an adhesive, each of the facings being a half-shell of sheet metal including a planar rectangular sheet with four sides having borders folded over the edges of the panel, two respective folded-over borders of the two half-shells, located on the same edge of the panel, comprising means or assembling the panel to an adjacent panel, each of the folded-over borders including a first part perpendicular to the sheet of the corresponding half-shell, folded over onto the corresponding panel edge and having a width less than one-half the thickness of the core, a second part folded perpendicular to the first part, and a third part folded perpendicular to the second part, the two folded-over borders located on the same edge of the panel being arranged to cooperate with the two similar folded-over borders of an adjacent panel, two clip sections of U-shaped cross section including a central section parallel to the plane of the adjacent panels and two flanges that press against the two first parts of cooperating folded-over borders of adjacent panels, and a spring pressing said flanges against the corresponding first parts.

2. An insulating, fire-retardant partitioning panel including a core of cellular glass between two facings to form a composite sandwich-type structure with edges, characterized in that the cellular glass core is joined to the two facings by an adhesive, each of the facings being a half-shell of sheet metal including a planar rectangular sheet with four sides having borders folded over the edges of the panel, two respective folded-over borders of the two half-shells, located on the same edge of the panel, comprising means for assembling the panel to an adjacent panel, said two respective folded-over borders of the two half-shells including a first part folded toward the corresponding panel edge and a second part folded in the thickness of the cellular glass core, to form a female-type nesting element, and a simulated tongue glued in the female-type nesting element to form a projecting male-type nesting element.

3. An insulating, fire-retardant partitioning panel including a core of cellular glass between two facings to form a composite sandwich-type structure, characterized in that the cellular glass core is joined to the two facings by an adhesive, each facing comprising a metal sheet extending over the entire surface of the panel, said panel including an edge with a groove therein and a simulated tongue of generally rectangular cross section on an adjacent panel arranged for reception within said groove, said groove being defined by a section of sheet metal recessed in the thickness of the cellular glass core, and a fireproofing gasket placed between two adjacent panels on either side of the simulated tongue.

4. An insulating, fire-retardant partitioning panel including a core of cellular glass between two facings to form a composite sandwich-type structure, characterized in that the cellular glass core is joined to the two facings by an adhesive, each facing being formed of a sheet based on a silicate of alumina fibers.

* * * * *